United States Patent [19]

Shannon

[11] Patent Number: 4,716,594

[45] Date of Patent: Jan. 5, 1988

[54] PROTECTIVE GARMENT FOR PROTECTION AGAINST MOSQUITOES AND OTHER INSECTS

[76] Inventor: Keith Shannon, Rte. 2, Box 223X, Hopkins, S.C. 29061

[21] Appl. No.: 38,043

[22] Filed: Apr. 14, 1987

[51] Int. Cl.[4] ..... A41B 13/00; A42B 3/00

[52] U.S. Cl. ..... 2/4; 2/DIG. 1

[58] Field of Search ..... 2/4, DIG. 1, 2, 16, 2/22; 36/2 R

[56] References Cited

U.S. PATENT DOCUMENTS

| | | | |
|---|---|---|---|
| 2,074,390 | 3/1937 | Green | 2/4 X |
| 3,191,185 | 6/1965 | Martin | 2/22 |
| 3,783,451 | 1/1974 | Malin | 2/4 |

FOREIGN PATENT DOCUMENTS

| | | | |
|---|---|---|---|
| 1435981 | 3/1969 | Fed. Rep. of Germany | 2/DIG. 1 |
| 2108822 | 5/1983 | United Kingdom | 2/DIG. 1 |
| 267858 | 5/1976 | U.S.S.R. | 2/4 |

*Primary Examiner*—H. Hampton Hunter

*Attorney, Agent, or Firm*—Bell, Seltzer, Park & Gibson

[57] ABSTRACT

A protective garment for protection against mosquitoes and other insects is provided. The garment comprises a plurality of fabric components with stitching forming seams securing the components together. The fabric components are multilayered and comprise inner and outer layers of fabric which are connected at the seams. The outer layer of fabric is constructed so as to prevent passage of mosquitoes and other insects therethrough. The inner layer of fabric is a coarse mesh fabric with relatively large openings therein and is many times thicker than the thickness of the outer layer of fabric so as to serve as a spacer layer to space the skin of the wearer of the garment at such a distance from the outer surface of the garment that mosquitoes, even in the event of sticking their heads between yarns forming the outer fabric layer, cannot span the distance to the skin of the wearer so as to bite the wearer.

12 Claims, 9 Drawing Figures

PROTECTIVE GARMENT FOR PROTECTION AGAINST MOSQUITOES AND OTHER INSECTS

FIELD OF THE INVENTION

The present invention relates to protective garments adapted to be worn by outdoorsmen to provide protection against mosquitoes and other insects.

BACKGROUND OF THE INVENTION

Mosquitoes and other biting and stinging insects have long been the bane of hunters and outdoorsmen. Various chemicals, often in the form of sprays and smoke, and electrical devices have been developed to protect hunters, but with limited success and applicability in the woods. Various designs of protective garments are available which recognize the need for clothing that substantially reduces the irritation to outdoorsmen caused by insect bites and stings.

U.S.S.R. Pat. No. 267,858 discloses a suit designed for protection against blood sucking insects. The suit includes a shirt of two-piece construction with an inner shirt layer of more open netting being separate from an outer shirt layer and where the collective layers have a combined thickness of about 3.8 mm (¼ inch). Further, exemplary garments are disclosed in U.S. Pat. No. 2,028,947 to Palm, U.S Pat. No. 2,074,390 to Green, U.S. Pat. No. 3,191,185 to Martin and U.S. Pat. No. 3,783,451 to Malin. This group of patents discloses garments which utilize various devices such as buttons, springs, spacers made of rope, plastic or cloth tufts, inflatable tubes, plastic inserts and the like to space the garment away from the body of the wearer so as to prevent an insect or snake from biting or stinging the wearer through the garment. However, use of such devices is most often limited to only certain areas of the garment inasmuch as such spacing means cannot be located at areas of the garment where the wearer would cause the spacing means to bear directly on their skin such as in the seat of a pair of trousers when in a sitting position or the chest area of a shirt when in a prone position on the ground. Moreover, these prior art devices are expensive and difficult to manufacture on a broad scale, and as far as applicant knows have not been commercialized to any extent.

An object of this invention is to provide a comfortable and economically constructed multilayered fabric protective garment for hunters and outdoorsmen comprising interconnected inner and outer fabric layers and which provides protection against mosquitoes and other types of insects by the inner layer of fabric serving as a spacer layer to space the skin of the wearer of the garment at such a distance from the outer surface of the garment that mosquitoes cannot span the same so as to bite the wearer thereof.

An additional object is to provide a protective garment formed of a composite fabric of inner and outer connected layers of mesh fabric, and wherein the inner layer is a coarse mesh fabric and is considerably thicker than the outer mesh layer, and wherein the yarns forming the inner layer are many times larger than the yarns forming the outer fabric layer so as to provide a desired effective spaced relation to prevent the stingers of insects from penetrating through the outer fabric and engaging the skin of the wearer.

SUMMARY OF THE INVENTION

In accordance with the present invention, applicant provides a protective garment which provides protection against mosquitoes and other types of insects. To this end, a garment comprising a plurality of fabric components with stitching forming seams securing the components together is provided. The fabric components are multilayered and comprise inner and outer layers of fabric. The outer layer of fabric is constructed so as to prevent passage of mosquitoes and other insects therethrough. The inner layer of fabric is a coarse mesh fabric with relatively large openings therein and is many times thicker than the thickness of the outer layer of fabric so as to serve as a spacer layer to space the skin of the wearer of the garment at such a distance from the outer surface of the garment that mosquitoes, even in the event of sticking their heads between yarns forming the outer fabric layer, cannot span the distance to the skin of the wearer so as to bite the wearer.

BRIEF DESCRIPTION OF THE DRAWINGS

The foregoing and other objects, features and advantages of the present invention will be made apparent from the following detailed description of preferred embodiments of the invention, and from the drawings, in which.

DETAILED DESCRIPTION OF THE INVENTION

Figure 1:
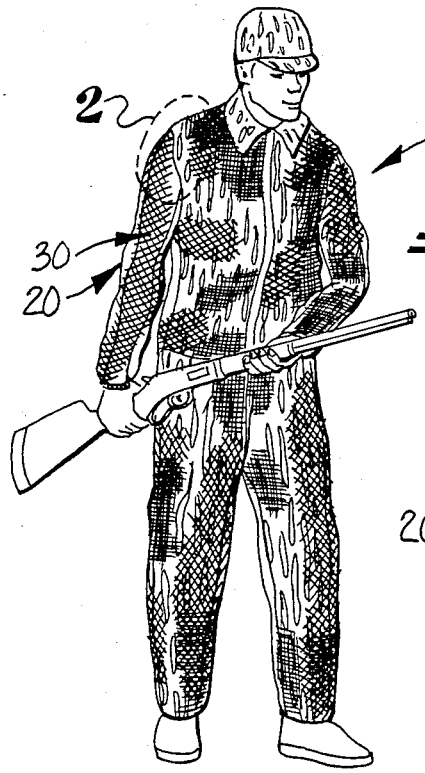
FIG. 1 is a perspective view of a hunter wearing an embodiment of the present invention.

Protective garments for use by outdoorsmen and formed of an inner and outer layer of fabric are illustrated in the Figure. The protective garments are particularly suited for use by hunters and outdoorsmen as shown in FIG. 1. These garments offer superior protection against the bites and stings of mosquitoes, bees, hornets, wasps and the like. These garments also provide less constriction in the joint area and are cooler than the prior art protective garments.

Figure 2:
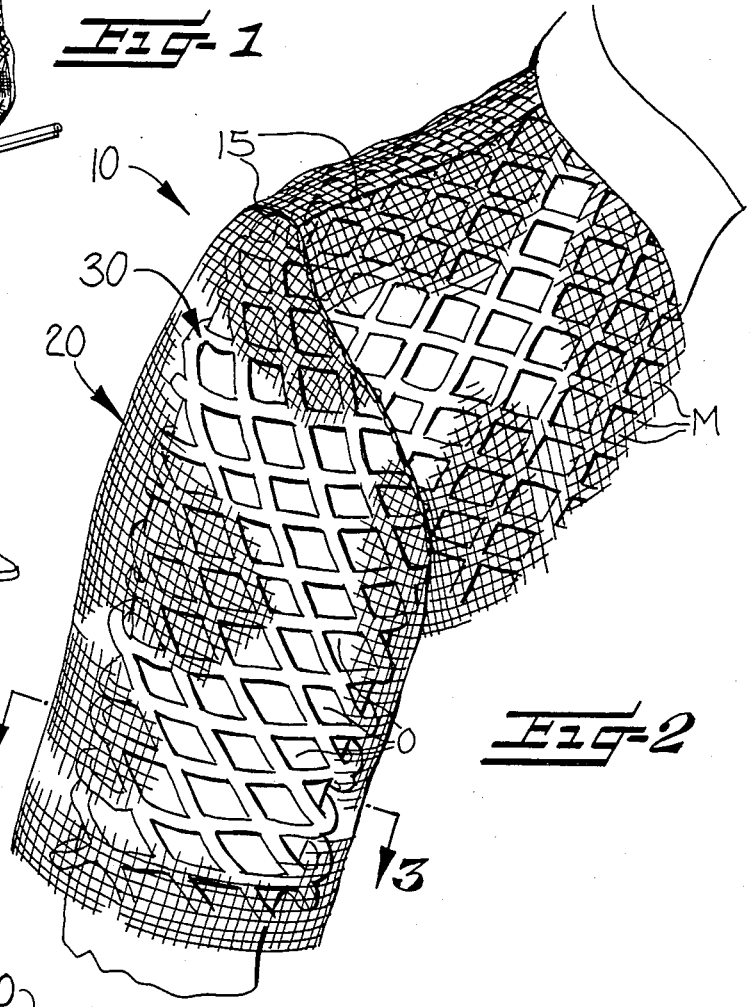
FIG. 2 is an enlarged fragmentary perspective view of the shoulder and arm area of the garment identified as 2 in FIG. 1.

Referring to the Figure, the specific construction of the subject garments is illustrated by a representative garment generally indicated by the reference numeral 10. As shown in FIG. 2, the garment 10 comprises an outer fabric layer 20 and an inner coarse mesh fabric layer 30 wherein the layers are secured together by stitching forming seams 15.

The outer fabric layer 20 can be formed of a knit or woven fabric made from natural or synthetic yarns. A knit mesh nylon fabric such as the light-weight material commonly sold as mosquito netting is particularly desirable. The mesh dimension thereof is between 1/32 inch to ⅛ inch and utilizes very small yarns. Such a mesh fabric is inherently cool for hot weather wear and also is of a construction so as to prevent passage of mosquitoes and other insects completely through the fabric. It is recognized that the outer layer can also be a conventional knit or woven material such as the kind commonly used to make shirts.

Figure 4:
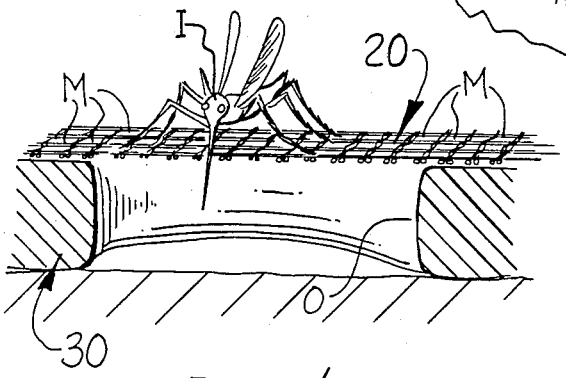
FIG. 4 is an enlarged detailed view illustrating the inability of an insect such as a mosquito to span the space between the outer surface of the garment so as to bite the skin of the wearer.
Figure 3:
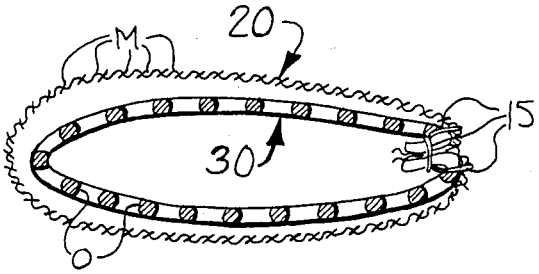
FIG. 3 is a transverse sectional view taken along line 3—3 of FIG. 2.

With respect to the inner fabric layer 30, it is preferably a coarse mesh fabric made of a blend of synthetic and cotton fibers and utilizes yarns having a thickness of about 2/16 inch to 7/16 inch. As shown in FIGS. 3 and 4, by utilizing considerably larger thickness yarns in the inner fabric layer 30 than the outer fabric layer 20, the inner layer 30 serves as a spacer layer to space the skin S of the wearer of the garment at such a distance from the outer surface of the outer layer 20 that insects such as mosquitoes I as shown in FIG. 4 cannot span the distance to the skin of the wearer so as to bite the wearer.

Additionally, the mesh of the inner fabric layer 30 has relatively large openings of a dimension of between ¼ inch and 1 inch which is significantly greater than that of the outer fabric layer. This is illustrated in FIGS. 5–8 where it is shown that there are approximately eight to nine mesh openings M of the outer fabric layer 20 to one coarse mesh opening O of the inner fabric layer 30. The larger mesh allows the garment to be cool in hot weather due to the ability of air to circulate to the body of the wearer.

The inner fabric layer 20 and outer fabric layer 30 are desirably connected to each other only by the stitching at the seams 15, except for possibly light stitch tacking of the layers to each other to facilitate handling thereof during the stitching of the fabric components. The fabric components of the garment are desirably connected together so that the layers are substantially free even with light stitch tacking. When the fabric layers are substantially free, they tend to naturally permit better air circulation which keeps the wearer cooler. Additionally, such a constuction reduces the amount of constriction at the joints such as the elbow or knee of the wearer. Also, the layers being free tend to separate and therefore make it more difficult for an insect to span the distance to the skin of the wearer. Optionally, the layers may be thermally fused together by utilizing a thermoplastic yarn in one or both of the layers.

It is preferred that the outer fabric layer 20 be colored or dyed with a camouflage motif, FIG. 1, so as to provide concealment for the hunter in the woods or brush. The inner layer 30 may also be dyed with the same motif or may be dark colored such as gray, green or brown so as to blend in with the camouflage motif of the outer layer 20.

Figure 9:
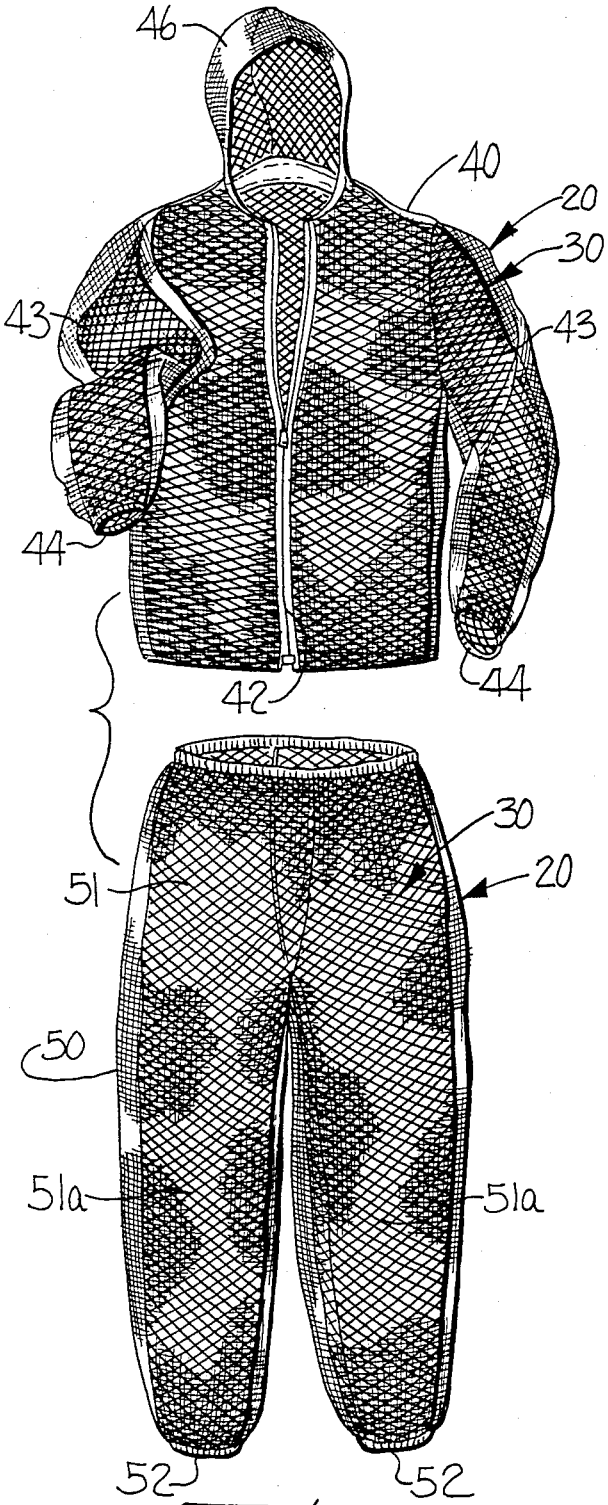
FIG. 9 is a perspective view of another exemplary garment embodiment of the invention.
Figure 5:
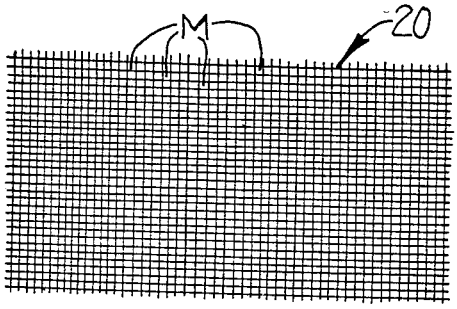
FIG. 5 is a plan view illustrating the actual size of the outer mesh fabric layer.
Figure 6:
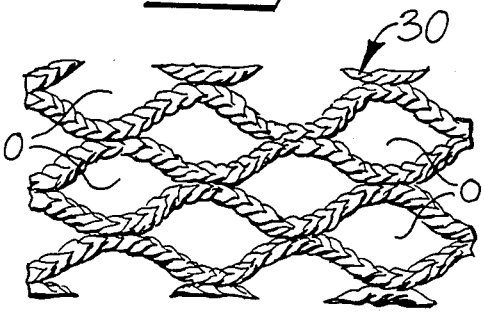
FIG. 6 is a plan view illustrating the actual size of the coarse inner mesh fabric layer.
Figure 7:
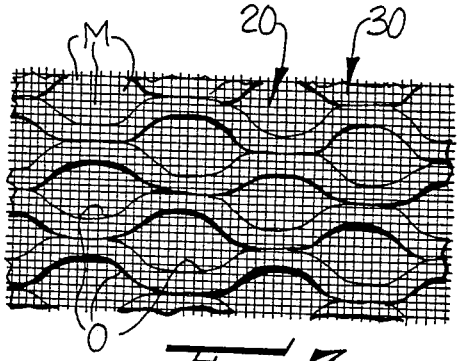
FIG. 7 is a plan view illustrating the outer fabric layer superimposed on the inner fabric layer.
Figure 8:
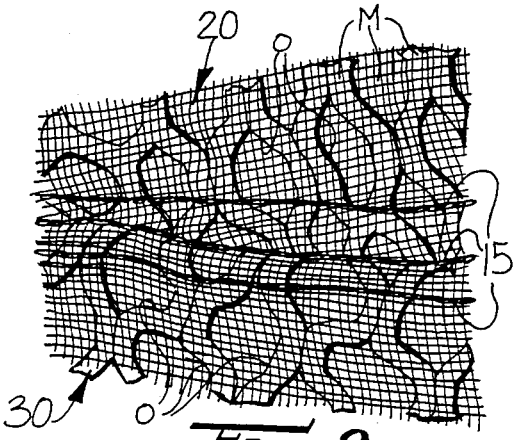
FIG. 8 is a plan view illustrating a seam interconnecting the outer and inner fabric layers.

FIG. 9 illustrates an embodiment of the invention wherein a typical outfit comprises a hooded shirt 40 and a pair of trousers 50. The shirt 40 includes a body portion 41 adapted to cover the upper body of the wearer and may include a zipper 42 extending the length of the front of the body portion 41. Sleeves 43 are adapted to cover the arms of the wearer and include elastic cuffs 44 for constricting the ends of the sleeves 43 around the wrist of the wearer. The means for constricting may be a knit construction, elastic bands or a drawstring so long as the passage of mosquitoes and insects up through the open end of the sleeves 43 is prevented. The shirt may also include a hood portion 46 which can be folded up into a collar when not in use, and the hood portion 46 may include a see-through head net to cover the face of the wearer.

The pair of trousers 50 shown is a pull-over type for wearing over an existing pair of pants. The trousers 50 include a body portion 51 and legs **51*a* adapted to cover the legs of the wearer and elastic cuffs 52 for constricting the ends of the trousers 50** around the ankles of the wearer. Again, the means for constricting may be knit construction, elastic bands or a drawstring.

The protective garments of the present invention, although simple and easy to construct, offer superior protection against the irritating bites and stings of mosquitoes and insects. The garments are comfortable to wear even in hot weather conditions and with respect to the range of body motion possible.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A protective garment adapted to be worn by hunters and other outdoor people to provide protection against mosquitoes and other types of insects, said garment comprising a plurality of fabric components, said fabric components being multilayered and comprising inner and outer layers of fabric, and stitching forming seams securing the fabric components together and interconnecting the inner and outer layers of fabric to form the garment, the outer layer of fabric having a construction so as to prevent passage of mosquitoes and other insects therethrough, the inner layer of fabric being a coarse mesh fabric with relatively large openings therein and being many times thicker than the thickness of the outer layer of fabric so as to serve as a spacer layer to space the skin of the wearer of the garment at such a distance from the outer surface of the garment that mosquitoes, even in the event of sticking their heads between yarns forming the outer fabric layer, cannot span the distance to the skin of the wearer so as to bite the wearer.

2. A protective garment according to claim 1 wherein said inner and outer layers of fabric are substantially free and unconnected to each other except at the seams.

3. A protective garment according to claim 1 wherein the relatively large openings of said inner fabric have a dimension of about ½ inch to 1 inch.

4. A protective garment according to claim 1 wherein said outer layer of fabric is made of a synthetic material.

5. A protective garment according to claim 1 wherein said inner layer of fabric is formed of yarns of a blend of synthetic and cotton fibers and wherein the yarns have a thickness of about 2/16 inch to 7/16 inch.

6. A protective garment adapted to be worn by hunters and other outdoor people to provide protection against mosquitoes and other types of insects, said garment comprising a plurality of fabric components, said fabric components being multilayered and comprising inner and outer layers of mesh fabric, and stitching forming seams securing the fabric components together and interconnecting the inner and outer layers of fabric to form the garment, the openings in the outer layer of fabric being considerably smaller than the openings in the inner layer of fabric and of such small size as to prevent passage of mosquitoes and other insects therethrough, and wherein the yarns forming the inner layer are considerably larger than the yarns forming the outer layer so that the inner layer serves as a spacer layer to space the skin of the wearer of the garment at such a distance from the outer surface of the garment that mosquitoes, even in the event of sticking their heads between yarns forming the outer mesh fabric layer, cannot span the distance to the skin of the wearer so as to bite the wearer.

7. A protective garment according to claim 6, wherein said inner and outer layers of mesh fabric forming said fabric components are substantially free and unconnected to each other except at the seams.

8. A protective garment according to claim 6 wherein the openings in the outer layer of mesh fabric have a dimension of about 1/32 inch to ⅛ inch and the openings in the inner layer of mesh fabric have a dimension of about ½ inch to 1 inch.

9. A protective garment adapted to be worn by hunters and other outdoor people to provide protection against mosquitoes and other types of insects and to provide concealment for the hunter in the woods and brush, said garment comprising a plurality of fabric components, said fabric components being multilayered and comprising outer and inner layers of mesh knit fabric, and stitching forming seams securing the fabric components together and interconnecting the inner and outer layers of fabric to form the garment, the outer layer of mesh knit fabric having a camouflage motif printed thereon and the inner layer of mesh knit fabric being a dark colored fabric so as to blend in with the camouflage motif of the outer layer, and with the openings in the outer layer of mesh knit fabric being considerably smaller than the openings in the inner layer of fabric, and of such small size as to prevent passage of mosquitoes and other insects therethrough, and wherein the yarns forming the inner layer are considerably larger than the yarns forming the outer layer so that the inner layer serves as a spacer layer to space the skin of the wearer of the garment at such a distance from the outer surface of the garment that mosquitoes, even in the event of sticking their heads between yarns forming the outer mesh fabric layer, cannot span the distance to the skin of the wearer so as to bite the wearer.

10. A protective garment according to claim 9, wherein said garment comprises a shirt including a body portion adapted to cover the upper body portion of the wearer, sleeves adapted to cover the arms of the wearer and cuffs having means for constricting the lower open end of the sleeves around the wrist of the wearer so as to prevent passage of mosquitoes and insects up through the lower open end of the sleeves.

11. A protective garment according to claim 9 wherein said shirt further includes a collar and a hood portion integrally formed with said collar.

12. A protective garment according to claim 9, wherein said garment comprises a pair of trousers including leg portions adapted to cover the legs of the wearer and cuffs having means for constricting lower leg openings around the ankles of the wearer so as to prevent passage of mosquitoes and insects therethrough.

* * * * *